US010711362B2

(12) United States Patent
Furukawa

(10) Patent No.: US 10,711,362 B2
(45) Date of Patent: Jul. 14, 2020

(54) ANODIC OXIDE FILM FORMING TREATMENT AGENT AND METHOD OF FORMING AN ANODIC OXIDE FILM

(71) Applicant: HONDA MOTOR CO., LTD., Minato-ku, Tokyo (JP)

(72) Inventor: Yuki Furukawa, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/262,997

(22) Filed: Jan. 31, 2019

(65) Prior Publication Data

US 2019/0242025 A1 Aug. 8, 2019

(30) Foreign Application Priority Data

Feb. 2, 2018 (JP) ..... 2018-016894

(51) Int. Cl.
*C25D 11/16* (2006.01)
*C25D 11/08* (2006.01)
*C25D 11/20* (2006.01)

(52) U.S. Cl.
CPC ..... *C25D 11/08* (2013.01); *C25D 11/16* (2013.01); *C25D 11/20* (2013.01)

(58) Field of Classification Search
None
See application file for complete search history.

(56) References Cited

U.S. PATENT DOCUMENTS 4,153,571 A 5/1979 Garvin et al.
4,293,441 A * 10/1981 Newell ..... C09K 5/20 106/14.12
4,444,628 A * 4/1984 Furukawa ..... C23F 3/03 205/201
7,780,838 B2 * 8/2010 Ostrovsky ..... C25D 11/30 205/200

FOREIGN PATENT DOCUMENTS

DE 1204046 * 10/1965 ..... C25D 11/26
JP 45-009444 4/1970

(Continued)

OTHER PUBLICATIONS

Japanese Office Action for Japanese Patent Application No. 2018-016894 dated Jul. 30, 2019.

(Continued)

*Primary Examiner* — Stefanie S Wittenberg
(74) *Attorney, Agent, or Firm* — Amin, Turocy & Watson, LLP

(57) ABSTRACT

An anodic oxide film forming treatment agent for forming an anodic oxide film on a substrate made of aluminum or an aluminum alloy is made of a viscous substance obtained by increasing the viscosity of an electrolytic solution by a nonionic surfactant. A method of forming an anodic oxide film in which the anodic oxide film forming treatment agent is used includes a contacting step of bringing the anodic oxide film forming treatment agent into contact with the substrate, and an energizing step of using the substrate as an anode, and carrying out conduction of electricity between the substrate and a cathode provided in the anodic oxide film forming treatment agent.

5 Claims, 3 Drawing Sheets

(56) References Cited

FOREIGN PATENT DOCUMENTS

| | | | | |
|---|---|---|---|---|
| JP | 50-098907 | | 8/1975 | |
| JP | 63-241196 | | 10/1988 | |
| JP | 07-186433 | | 7/1995 | |
| JP | 11-236696 | | 8/1999 | |
| JP | 2009-013442 | | 1/2009 | |
| WO | 2016/093782 | | 6/2016 | |
| WO | WO2016093782 | * | 6/2016 | ..... C25D 11/00 |

OTHER PUBLICATIONS

Tanizaki, "Macromolecular surfactant", Oil Chemistry, 1985, vol. 34, No. 11, pp. 973-978.
Chinese Office Action and Search Report for Chinese Patent Application No. 201910104986.X dated Feb. 18, 2020.

* cited by examiner

FIG. 3

| EMBODIMENT | TYPE (ADEKA NOL) | CONCENTRATION [wt%] | VISCOSITY [mPa·s] | FLUIDITY |
|---|---|---|---|---|
| A | GT-730 | 5.1 | | DECREASED |
| B | GT-730 | 10.2 | 40000 | DECREASED |
| C | GT-730 | 26.5 | | DECREASED |
| D | GT-1306 | 5.1 | | DECREASED |
| E | GT-1306 | 12.8 | 50000 | DECREASED |
| F | GT-1306 | 18.0 | 150000 | DECREASED |
| G | GT-1306 | 38.8 | | DECREASED |
| H | UH-752 | 10.2 | 90.4 | DECREASED |
| I | UH-752 | 27.7 | 100000 | DECREASED |
| J | UH-752 | 38.8 | 200000 | DECREASED |

ANODIC OXIDE FILM FORMING TREATMENT AGENT AND METHOD OF FORMING AN ANODIC OXIDE FILM

CROSS-REFERENCE TO RELATED APPLICATION

This application is based upon and claims the benefit of priority from Japanese Patent Application No. 2018-016894 filed on Feb. 2, 2018, the contents of which are incorporated herein by reference.

BACKGROUND OF THE INVENTION

Field of the Invention

The present invention relates to an anodic oxide film forming treatment agent and a method of forming an anodic oxide film, for forming an anodic oxide film on a substrate made of aluminum or an aluminum alloy.

Description of the Related Art

Formation of an anodic oxide film (alumite) is carried out on the surface of a substrate made of aluminum or an aluminum alloy, for the purpose of enhancing a heat insulating property, abrasion resistance, or the like of the aluminum or the aluminum alloy.

As a method of forming an anodic oxide film, it is known to carry out electrolysis, in which a substrate and a cathode are immersed in an electrolytic solution, and wherein the substrate is used as an anode. As a result of electrolysis, oxygen which is generated on the side of the substrate reacts with the aluminum at the surface of the substrate, thereby forming an anodic oxide film made up from aluminum oxide.

As this type of anodic oxide film, for example, in Japanese Laid-Open Patent Publication No. 11-236696, a method of forming an anodic oxide film has been proposed in which the anodic oxide film is formed while spraying an electrolytic solution toward the substrate by a large number of electrolyte solution ejection ports provided in an electrolytic bath in order to increase a film formation rate while suppressing non-uniformity of the film thickness.

SUMMARY OF THE INVENTION

However, in order to increase the film formation rate of the anodic oxide film by the above-described formation method, large-scale and complicated equipment such as ejection mechanisms or the like are required.

A principal object of the present invention is to provide an anodic oxide film forming treatment agent which, with a simple configuration, is capable of increasing the film formation rate of an anodic oxide film.

Another object of the present invention is to provide a method of forming an anodic oxide film in which, with a simple configuration, it is possible to increase the film formation rate of an anodic oxide film.

According to an embodiment of the present invention, an anodic oxide film forming treatment agent is provided, which is adapted to form an anodic oxide film on a substrate made of aluminum or an aluminum alloy, wherein the anodic oxide film forming treatment agent is made of a viscous substance obtained by increasing a viscosity of an electrolytic solution by a nonionic surfactant.

According to keen examinations made by the inventors, it has been understood that, by using a nonionic surfactant, it is possible to satisfactorily increase the viscosity of the electrolytic solution for the purpose of performing the anodic oxidizing treatment. For example, with a liquid electrolytic solution which is not increased in viscosity, even if oxygen is generated on the side of the substrate by electrolysis using the substrate as an anode, since the oxygen is easily separated from the substrate depending on the flow of the liquid electrolytic solution, cases may occur in which the electrolytic solution does not contribute to a reaction that causes generation of the anodic oxide film.

On the other hand, in the case that the above-described electrolysis is carried out by bringing an anodic oxide film forming treatment agent, which is made up of a viscous substance, into contact with the substrate, flowing of the anodic oxide film forming treatment agent can be suppressed, and therefore, the oxygen generated on the side of the substrate tends to remain in proximity to the surface of the substrate. As a result, it is possible to positively contribute generated oxygen to the reaction that causes generation of the anodic oxide film, to promote the reaction, and hence to further increase the film formation rate of the anodic oxide film.

Therefore, in accordance with such an anodic oxide film forming treatment agent, by a simple configuration in which the electrolytic solution is made into a viscous substance by a nonionic surfactant, and without the use of special equipment, for example, such as ejection mechanisms or the like, it is possible to increase the film formation rate of the anodic oxide film. In addition, as described above, even if the voltage (current density) between the anode and the cathode is not increased, since the film formation efficiency is raised, and the film formation rate can be increased, non-uniformity in the film thickness of the anodic oxide film is suppressed while facilitating thickening of the film.

In addition, the anodic oxide film forming treatment agent, which is made of a viscous substance, can be easily molded, and is capable of maintaining a desired shape. Therefore, for example, by placing the anodic oxide film forming treatment agent on the substrate, or supporting the anodic oxide film forming treatment agent in a state of being in contact with the substrate, it is also possible to form the anodic oxide film with a superior film formation rate, and without using an electrolytic bath per se. Stated otherwise, in accordance with the anodic oxide film forming treatment agent, it is possible to remarkably simplify the equipment for forming the anodic oxide film, and to achieve a savings in space.

The above-described anodic oxide film forming treatment agent preferably covers a film forming site where the anodic oxide film is formed on the substrate, and is of a shape that allows a non-forming site exclusive of the film forming site of the substrate to remain exposed. As described above, since the anodic oxide film forming treatment agent, which is made of a viscous substance, can be molded into a desired shape, a shape can be formed which is capable of being selectively brought into contact with the film forming site of the substrate. In this case, it is possible to partially form the anodic oxide film with respect to the substrate, without undergoing a complicated step such as masking or the like.

Further, since the viscous substance can be made to possess flexibility, for example, even in the case that the film forming site is composed of a curved surface, an inclined surface, or the like, the anodic oxide film forming treatment agent is capable of being deformed in a manner so as to follow the shape of the film forming site. Consequently, since the anodic oxide film forming treatment agent can suitably be brought into contact with the entire film forming site, non-uniformity in the film thickness can be suppressed, and an anodic oxide film can be formed which is excellent in quality.

In the above-described anodic oxide film forming treatment agent, a viscosity of the anodic oxide film forming treatment agent at room temperature preferably is greater than or equal to 10,000 mPa·s. In this case, it is possible to suitably maintain the anodic oxide film forming treatment agent in a state of being molded in a desired shape, and to bring the anodic oxide film forming treatment agent into contact with the film forming site easily and with high accuracy.

According to another embodiment of the present invention, there is provided an anodic oxide film forming method of forming an anodic oxide film on a substrate made of aluminum or an aluminum alloy, comprising a contacting step of bringing an anodic oxide film forming treatment agent, which is made of a viscous substance obtained by increasing a viscosity of an electrolytic solution by a nonionic surfactant, into contact with the substrate, and an energizing step of using the substrate as an anode, and carrying out conduction of electricity between the substrate and a cathode provided in the anodic oxide film forming treatment agent.

In such a method of forming the anodic oxide film, in the contacting step, the anodic oxide film forming treatment agent, which is made of a viscous substance in which flowing thereof is suppressed, is brought into contact with the substrate, and in the energizing step, electrolysis is performed using the substrate as an anode. Consequently, it is possible for the oxygen generated on the side of the substrate to remain in the vicinity of the surface of the substrate, and to promote the reaction by which the anodic oxide film is generated. As a result, the film formation rate of the anodic oxide film can be increased.

Accordingly, in the method of forming the anodic oxide film, by means of a simple configuration in which an anodic oxide film forming treatment agent is used which is made of a viscous substance of an electrolyte which is increased in viscosity by a nonionic surfactant, the occurrence of non-uniformity in the film thickness can be suppressed while the formation rate of the anodic oxide film can be increased. In addition, since the anodic oxide film forming treatment agent is made up from a viscous substance, it is also possible to form the anodic oxide film forming treatment agent without using an electrolytic bath. In this case, the equipment for forming the anodic oxide film can be remarkably simplified, and a savings in space can be achieved.

In the above-described anodic oxide film forming method, in the contacting step, the anodic oxide film forming treatment agent, which covers a film forming site where the anodic oxide film is formed on the substrate, and which is of a shape that allows a non-forming site exclusive of the film forming site of the substrate to remain exposed, is preferably brought into contact with the film forming site. In this case, it is possible to partially form the anodic oxide film with respect to the substrate, without undergoing a complicated step such as masking or the like. Further, by having the viscous substance possess flexibility, for example, even if the film forming site is composed of a curved surface, an inclined surface, or the like, the anodic oxide film forming treatment agent can be brought into contact with the entire film forming site, non-uniformity in the film thickness can be suppressed, and an anodic oxide film can be formed which is excellent in quality.

In the above-described anodic oxide film forming method, in the contacting step, it is preferable that the anodic oxide film forming treatment agent, which has a viscosity at room temperature of greater than or equal to 10,000 mPa·s, is brought into contact with the substrate. In this case, since it is possible to suitably maintain the anodic oxide film forming treatment agent in a state of being molded in a desired shape, the anodic oxide film forming treatment agent can be brought into contact with the film forming site easily and with high accuracy.

In the above-described anodic oxide film forming method, in the contacting step, it is preferable that the anodic oxide film forming treatment agent, which has been cooled to a temperature of −30° C. to 0° C., is brought into contact with the film forming site. In this case, since the anodic oxide film forming treatment agent is previously cooled so as to have a temperature within the above range, even if the temperature of the anodic oxide film forming treatment agent rises due to Joule heating or the like that is generated in the energizing step, it is possible to prevent the dissolution rate at which the anodic oxide film dissolves within the anodic oxide film forming treatment agent from becoming larger than the film formation rate.

Further, since it is also possible to suppress a decrease in the viscosity of the anodic oxide film forming treatment agent, it is possible to carry out the energizing step while suitably maintaining the shape of the molded anodic oxide film forming treatment agent. As a result, it becomes possible to form the anodic oxide film at a desired thickness on the substrate with high accuracy and high quality.

In the above-described anodic oxide film forming method, there is preferably further included a degreasing step in which, prior to the contacting step, a degreasing treatment agent, which is made of a viscous substance obtained by increasing a viscosity of an aqueous solution of sodium hydroxide by a nonionic surfactant, and having a shape covering the film forming site while leaving the non-forming site exposed, is brought into contact with the film forming site to perform a degreasing treatment thereon. By using the nonionic surfactant, the aqueous solution of sodium hydroxide can also be increased in viscosity in a satisfactory manner. Therefore, the degreasing treatment agent, which is made up from a viscous substance of an aqueous solution of sodium hydroxide that has been increased in viscosity, can be formed in a shape capable of being selectively brought into contact with the film forming site.

Accordingly, as a pretreatment process prior to the contacting step and the energizing step for forming the anodic oxide film, a complicated step such as masking or the like can be omitted, even in the degreasing step in which the degreasing treatment is carried out on the film forming site. Further, by having the viscous substance possess flexibility, even if the film forming site is composed, for example, of a curved surface, an inclined surface, or the like, the degreasing treatment agent, which has been deformed in a manner so as to follow the shape of the film forming site, can be brought into contact with the film forming site. Consequently, it is possible for the film forming site to be subjected to degreasing in a suitable manner. Furthermore, it is possible to easily avoid a situation in which the degreasing treatment agent comes into contact with the non-forming site, and therefore, in the degreasing step, it is possible to suppress a situation in which the non-forming site dissolves and the dimensions thereof change.

In the above-described anodic oxide film forming method, in the degreasing step, vibration preferably is applied in a state in which the degreasing treatment agent is in contact with the film forming site. In this case, the degreasing treatment on the film forming site can be performed more effectively.

The above and other objects, features, and advantages of the present invention will become more apparent from the following description when taken in conjunction with the accompanying drawings, in which preferred embodiments of the present invention are shown by way of illustrative example.

BRIEF DESCRIPTION OF THE DRAWINGS

FIG. 3 is a chart showing a relationship between a type of nonionic surfactant, a concentration of the nonionic surfactant with respect to an electrolytic solution, a viscosity of the nonionic surfactant, and a fluidity of the nonionic surfactant as compared with that of the electrolytic solution, for each of Examples A through J.

DESCRIPTION OF THE PREFERRED EMBODIMENTS

Preferred embodiments of an anodic oxide film forming treatment agent and an anodic oxide film forming method according to the present invention will be presented and described in detail below with reference to the accompanying drawings.

Figure 1A:
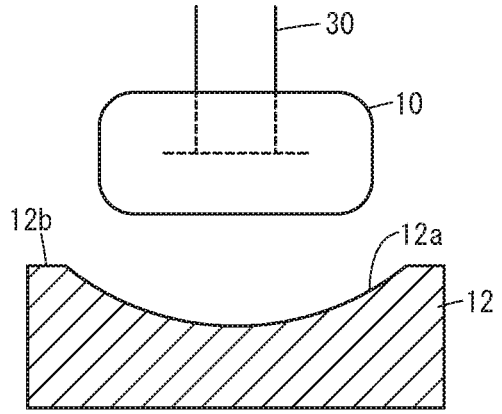
FIGS. 1A, 1B, and 1C are explanatory drawings for describing a contacting step and an energizing step in an anodic oxide film forming method according to an embodiment of the present invention.
Figure 1B:
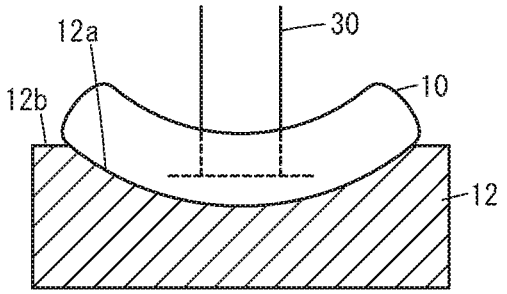
Figure 1C:
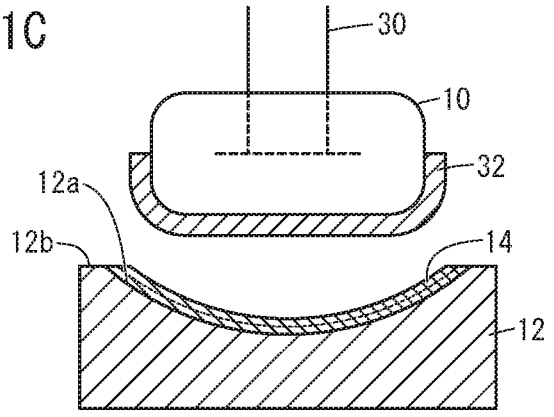

As shown in FIGS. 1A to 1C, an anodic oxide film forming treatment agent 10 according to the present embodiment is made up from a viscous substance in which an electrolytic solution is increased in viscosity by a nonionic surfactant, and is used in order to form an anodic oxide film 14 on a film forming site 12*a* of a substrate 12 composed of aluminum or an aluminum oxide.

The substrate 12 to which the anodic oxide film forming treatment agent 10 can be applied is not particularly limited, however, as a preferred example of the substrate 12, there may be cited a member that constitutes a combustion chamber of an internal combustion engine. Because the configuration of an internal combustion engine is well known, illustration and detailed explanation thereof will be omitted.

For example, in the case that the substrate 12 is a cylinder head, a bottom surface thereof that faces toward a combustion chamber can define the film forming site 12*a*, and other portions can define a non-forming site 12*b* where the anodic oxide film 14 is not formed. Further, inner wall surfaces of an intake port and an exhaust port of the cylinder head may also serve as the film forming site 12*a*. Apart from such locations, by forming the anodic oxide film 14 and increasing a heat insulating property of top surfaces of the pistons and inner surfaces of the bores of a cylinder block, such sites which are capable of reducing cooling losses of the internal combustion engine may also preferably define the film forming site 12*a*.

According to the present embodiment, the anodic oxide film forming treatment agent 10 is molded into a shape that covers the film forming site 12*a*, and allows the non-forming site 12*b* to remain exposed.

The electrolytic solution is not particularly limited, insofar as it is used in an ordinary type of anodic oxidizing treatment. However, preferably, the electrolytic solution is an acidic electrolytic solution such as a sulfuric acid aqueous solution or an oxalic acid aqueous solution. From the standpoint of increasing the film formation rate of the anodic oxide film 14, the electrolytic solution more preferably is a sulfuric acid aqueous solution. In this case, a preferred concentration of the sulfuric acid aqueous solution is set to 15% by weight or less.

The nonionic surfactant has a function of increasing the viscosity (gelling) of the electrolytic solution by mixing the nonionic surfactant with the electrolytic solution. As this type of nonionic surfactant, there can be used, for example, commercially available products such as the products manufactured under the trade names of "ADEKA NOL GT-730", "ADEKA NOL GT-1306", and "ADEKA NOL UH-752" by ADEKA Corporation.

The viscosity of the anodic oxide film forming treatment agent 10 can be adjusted by adjusting the concentration of the nonionic surfactant in the anodic oxide film forming treatment agent 10. The viscosity of the anodic oxide film forming treatment agent 10 may be appropriately adjusted depending on the state in which it is used. As described above, in the case that the anodic oxide film forming treatment agent 10 is formed in a shape that covers the film forming site 12*a* while allowing the non-forming site 12*b* to remain exposed, in order to make it easy to maintain the shape thereof, the viscosity of the anodic oxide film forming treatment agent 10 at room temperature preferably is greater than or equal to 10,000 mPa·s. The viscosity is a value that is measured using a B-type viscometer "Viscotester VT-04F" (trade name) manufactured by RION Co., Ltd.

Further, using the aforementioned commercially available products, in the case that the viscosity of the anodic oxide film forming treatment agent 10 at room temperature is greater than or equal to 10,000 mPa·s, the concentration of the nonionic surfactant in the anodic oxide film forming treatment agent 10 may be from 5 to 40 wt %.

The anodic oxide film forming treatment agent 10 is basically constituted in the manner described above. Hereinafter, while referring also to FIGS. 2A to 2B, an exemplary description will be presented concerning the anodic oxide film forming method according to the present embodiment, in which the anodic oxide film 14 is partially formed on the film forming site 12*a* exclusive of the non-forming site 12*b* of the substrate 12.

Figure 2A:
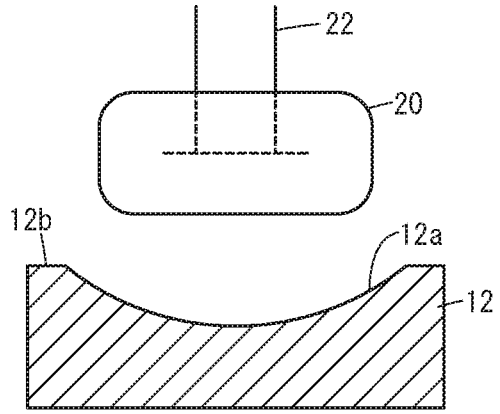
FIGS. 2A, 2B, and 2C are explanatory drawings for describing a degreasing step in the anodic oxide film forming method according to the embodiment of the present invention.

The anodic oxide film forming method includes a degreasing step in which a degreasing treatment is performed on the film forming site 12*a* prior to forming the anodic oxide film 14. As shown in FIG. 2A, in the degreasing step, first, a degreasing treatment agent 20 is prepared, which is made of a viscous substance obtained by increasing the viscosity of an aqueous solution of sodium hydroxide by a nonionic surfactant, and having a shape that covers the film forming site 12*a* while leaving the non-forming site 12*b* exposed.

A preferred concentration of the sodium hydroxide aqueous solution is set to 15% by weight or less. Further, concerning the sodium hydroxide aqueous solution as well, a viscous substance can be obtained by mixing the same nonionic surfactant as was used with the aforementioned electrolytic solution. At this time, in order to obtain the degreasing treatment agent 20 in which the aqueous sodium hydroxide solution and the nonionic surfactant are mixed substantially in a uniform manner, for example, it is preferable for the nonionic surfactant to be added and stirred into the sodium hydroxide aqueous solution which has been increased in temperature, whereby after having been mixed until becoming substantially uniform, and while stirring is continued, the mixed solution is allowed to cool, and the sodium hydroxide aqueous solution is increased in viscosity.

Further, in the case that the degreasing treatment agent 20 has the shape that was mentioned above, for example, the sodium hydroxide aqueous solution may be increased in viscosity inside a mold (not shown) corresponding to such a shape, or after having been increased in viscosity, the aqueous sodium hydroxide solution may be molded into such a shape. Further, concerning the degreasing treatment agent 20 as well, it is preferable to set the viscosity thereof at room temperature to be greater than or equal to 10,000 mPa·s.

In the case that electrolytic degreasing is carried out as the degreasing treatment, an electrode 22 constituting a cathode or the anode is disposed in the degreasing treatment agent 20. As the material of such an electrode 22, there can be applied thereto any material that is ordinarily used for electrolytic degreasing. The electrode 22 can be disposed in the degreasing treatment agent 20 by increasing the viscosity of the sodium hydroxide aqueous solution in a state in which a portion of the electrode 22 is immersed in the sodium hydroxide aqueous solution. Alternatively, the electrode 22 may be disposed in the degreasing treatment agent 20 by inserting the electrode 22 into the sodium hydroxide aqueous solution after the viscosity thereof has been increased.

Figure 2B:
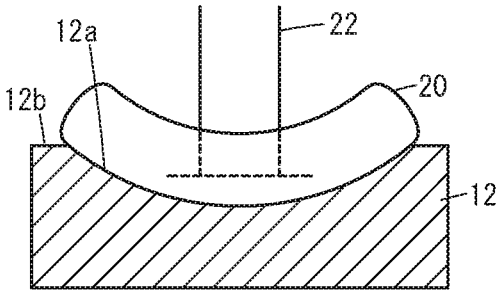

Next, as shown in FIG. 2B, for example, the degreasing treatment agent 20 is placed on the film forming site 12*a*, whereby the degreasing treatment agent 20 is brought into contact with the film forming site 12*a*. Moreover, the degreasing treatment agent 20 may be supported in a state of being in contact with the film forming site 12*a* using a non-illustrated supporting material or the like. At this time, since the degreasing treatment agent 20 has the above-described shape, the non-forming site 12*b* of the substrate 12 remains exposed. In this state, the degreasing treatment is performed on the film forming site 12*a* by carrying out conduction of electricity between the substrate 12 and the electrode 22. According to the present embodiment, the degreasing treatment is performed while applying vibration, by bringing a non-illustrated vibrating element into contact with the degreasing treatment agent 20 or the substrate 12, or the like. This type of vibration can be generated by a motor or an ultrasonic vibration device or the like (none of which are shown).

Figure 2C:
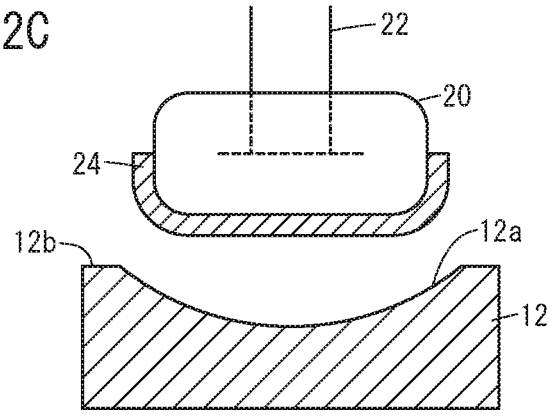

After the above-described degreasing treatment has been completed, as shown in FIG. 2C, the degreasing treatment agent 20 is separated away from the film forming site 12*a* and is collected in a collection container 24. Consequently, the surface is slightly dissolved, and a clean film forming site 12*a* is obtained from which fats and oils and other deposits have been removed.

Next, as shown in FIG. 1A, the anodic oxide film forming treatment agent 10 is prepared, which is of a shape that covers the film forming site 12*a* and leaves the non-forming site 12*b* exposed. The anodic oxide film forming treatment agent 10 can be prepared in substantially the same manner as the degreasing treatment agent 20, except that an electrolytic solution is used instead of the sodium hydroxide aqueous solution.

More specifically, in order to obtain the anodic oxide film forming treatment agent 10 in which the electrolytic solution and the nonionic surfactant are mixed substantially in a uniform manner, for example, it is preferable for the nonionic surfactant to be added and stirred into the electrolytic solution which has been increased in temperature, whereby after having been mixed until becoming substantially uniform, and while stirring is continued, the mixed solution is allowed to cool, and the electrolytic solution is increased in viscosity. Further, in order to provide the anodic oxide film forming treatment agent 10 with the above-described shape, the electrolytic solution may be increased in viscosity inside a mold (not shown) corresponding to such a shape, or after having been increased in viscosity, the electrolytic solution may be molded into such a shape.

A cathode 30 is provided in the anodic oxide film forming treatment agent 10. As the cathode 30, a cathode can be used which is made of a general material used in performing an anodic oxidizing treatment of carbon, platinum, or the like. The cathode 30 can also be disposed in the anodic oxide film forming treatment agent 10 in the same manner as in the case in which the electrode 22 is disposed in the degreasing treatment agent 20. More specifically, in a state in which a portion of the cathode 30 is immersed in the electrolytic solution, the electrolytic solution may be increased in viscosity, or alternatively, the cathode 30 may be inserted into the electrolytic solution after the electrolytic solution has been increased in viscosity.

In addition, after the anodic oxide film forming treatment agent 10, which is prepared in the manner described above, has been cooled to a temperature of −30° C. to 0° C., then as shown in FIG. 1B, the anodic oxide film forming treatment agent 10 is placed on the film forming site 12*a*. Consequently, a contacting step is carried out by which the anodic oxide film forming treatment agent 10 is brought into contact with the film forming site 12*a*. Moreover, the contacting step may be carried out with the anodic oxide film forming treatment agent 10 being supported in a state of being in contact with the film forming site 12*a* using a non-illustrated supporting material or the like. At this time, since the anodic oxide film forming treatment agent 10 has the above-described shape, the non-forming site 12*b* of the substrate 12 remains exposed. In this state, an energizing step is performed in which the substrate 12 is used as an anode, and energization or conduction of electricity is carried out between the substrate 12 and the cathode 30. More specifically, in the energizing step, electrolysis is performed using the substrate 12 as an anode.

Consequently, in the vicinity of the film forming site 12*a*, water (hydroxide ions) in the anodic oxide film forming treatment agent 10 are oxidized to thereby generate oxygen. The oxygen reacts with the aluminum or the like at the film forming site 12*a*, whereby the anodic oxide film 14 (an $Al_2O_3$ film) is formed on the surface of the film forming site 12*a*.

The voltage (electrolytic voltage) between the two electrodes in the energizing step, or the energization time may be suitably adjusted in an appropriate manner so as to obtain an anodic oxide film 14 having a desired thickness. Concerning the electrolytic voltage, when the electrolytic voltage is increased, the formation rate of the anodic oxide film 14 can be increased. On the other hand, the amount of generated Joule heat increases, making it easy for the anodic oxide film 14 to dissolve, and non-uniformity of the film thickness of the anodic oxide film 14 becomes likely to occur. Consequently, it is preferable to provide settings so as to achieve compatibility between increasing the formation rate and enhancing the quality of the anodic oxide film 14. More specifically, the electrolytic voltage is preferably on the order of 1 to 40 V, and more preferably, is on the order of 1 to 30 V.

After the above-described energizing step has been completed, as shown in FIG. 1C, the anodic oxide film forming treatment agent 10 is separated away from the film forming site 12*a* and is collected in a collection container 32. Consequently, the substrate 12 is obtained on which the anodic oxide film 14 has been formed at the film forming site 12*a* exclusive of the non-forming site 12*b*.

In the manner described above, in the anodic oxide film forming treatment agent 10 and the anodic oxide film forming method, the anodic oxide film forming treatment agent 10, which is made of a viscous substance in which flowing thereof is suppressed, is brought into contact with the film forming site 12*a*, and electrolysis is performed using the substrate 12 as an anode. Consequently, it is possible to positively contribute oxygen, which is generated on the side of the film forming site 12*a*, to a reaction that remains in the vicinity of the surface of the film forming site 12*a* and causes generation of the anodic oxide film 14, as well as to promote the reaction, and hence to further increase the film formation rate of the anodic oxide film 14.

Therefore, in accordance with the anodic oxide film forming treatment agent 10 and the anodic oxide film forming method, by a simple configuration in which the electrolytic solution is made into a viscous substance by a nonionic surfactant, and without the use of special equipment, it is possible to increase the film formation rate of the anodic oxide film 14. Further, as described above, even if the electrolytic voltage (current density) is not increased, since the film formation efficiency is raised, and the film formation rate can be increased, non-uniformity in the film thickness of the anodic oxide film 14 is suppressed while facilitating thickening of the film.

Further, in the above-described embodiment, the anodic oxide film forming treatment agent 10, which is made of a viscous substance, can be molded into a desired shape, and in the above-described embodiment, the anodic oxide film forming treatment agent 10 is of a shape that covers the film forming site 12*a* while allowing the non-forming site 12*b* to remain exposed. In this case, it is easy for the anodic oxide film 14 to be partially formed with respect to the substrate 12, without undergoing a complicated step such as masking or the like.

Furthermore, since the anodic oxide film forming treatment agent 10, which is made of a viscous substance, can be made to possess flexibility, for example, even in the case that the film forming site 12*a* is composed of a curved surface, an inclined surface, or the like, the anodic oxide film forming treatment agent 10 is capable of being deformed in a manner so as to follow the shape of the film forming site 12*a*. Consequently, since the anodic oxide film forming treatment agent 10 can suitably be brought into contact with the entire film forming site 12*a*, non-uniformity in the film thickness can be suppressed, and an anodic oxide film 14 can be formed which is excellent in quality.

In addition, with the anodic oxide film forming treatment agent 10 being made up from a viscous substance, the anodic oxide film forming treatment agent 10 can be placed on the film forming site 12*a*, or can be supported in a state of being in contact with the film forming site 12*a*. More specifically, the anodic oxide film forming treatment agent 10 can be placed in contact with the film forming site 12*a*, and the anodic oxide film 14 can be formed without using an electrolytic bath (not shown) or the like. Consequently, the equipment for forming the anodic oxide film 14 can be remarkably simplified, and a savings in space becomes possible.

As described above, according to the present embodiment, in the contacting step, the anodic oxide film forming treatment agent 10, which has been cooled so as to become a temperature of −30° C. to 0° C., is brought into contact with the film forming site 12*a*. In this manner, by the anodic oxide film forming treatment agent 10 being cooled beforehand, even if the anodic oxide film forming treatment agent 10 is raised in temperature due to Joule heating or the like that is generated in the energizing step, it is possible to prevent the dissolution rate at which the anodic oxide film 14 dissolves within the anodic oxide film forming treatment agent 10 from becoming larger than the film formation rate.

Further, since it is also possible to suppress a decrease in the viscosity of the anodic oxide film forming treatment agent 10, even if the temperature thereof rises, it is possible to carry out the energizing step while suitably maintaining the shape of the anodic oxide film forming treatment agent 10 which has been molded as described above. As a result, it becomes possible to form the anodic oxide film 14 at a desired thickness on the film forming site 12*a* with high accuracy and high quality.

As described above, according to the present embodiment, the degreasing step is carried out in which, prior to the contacting step, the degreasing treatment agent 20, which is made of a viscous substance obtained by increasing the viscosity of the sodium hydroxide aqueous solution by a nonionic surfactant, and having a shape that covers the film forming site 12*a* while leaving the non-forming site 12*b* exposed, is brought into contact with the film forming site 12*a* to perform a degreasing treatment thereon. By using the nonionic surfactant, the aqueous solution of sodium hydroxide can also be increased in viscosity in a satisfactory manner. Therefore, the degreasing treatment agent 20, which is made up from a viscous substance of an aqueous solution of sodium hydroxide that has been increased in viscosity, can be made into a shape capable of being selectively brought into contact with the film forming site 12*a*.

Accordingly, as a pretreatment process prior to the contacting step and the energizing step for forming the anodic oxide film 14, a complicated step such as masking or the like can be omitted, even in the degreasing step in which the degreasing treatment is carried out on the film forming site 12*a*. Further, by having the viscous substance possess flexibility, even if the film forming site 12*a* is composed, for example, of a curved surface, an inclined surface, or the like, the degreasing treatment agent 20, which has been deformed in a manner so as to follow the shape of the film forming site, can be brought into contact with the film forming site 12*a*. Consequently, it is possible for the film forming site 12*a* to be subjected to degreasing in a suitable manner. Furthermore, it is possible to easily avoid a situation in which the degreasing treatment agent 20 comes into contact with the non-forming site 12*b*, and therefore, in the degreasing step, it is possible to suppress a situation in which the non-forming site 12*b* dissolves and the dimensions thereof change.

As described above, in the degreasing step, vibration is applied in a state in which the degreasing treatment agent 20 is in contact with the film forming site 12*a*. Owing to this feature, the degreasing treatment on the film forming site 12*a* can be performed more effectively.

The present invention is not particularly limited to the above-described embodiments, and various modifications can be adopted within a range that does not depart from the essence and gist of the present invention.

For example, in the anodic oxide film forming treatment agent 10 and the anodic oxide film forming method according to the above-described embodiments, the anodic oxide film forming treatment agent 10 has a viscosity that is capable of maintaining the aforementioned shape, and the anodic oxide film 14 is formed partially on the film forming site 12*a*. However, the anodic oxide film forming treatment agent 10 may have a viscosity that enables the substrate 12 to be immersed therein, and the anodic oxide film 14 can be formed over the entirety of the substrate 12 using a treatment bath such as an electrolytic bath or the like, or can be formed partially thereon by performing masking or the like.

In this case as well, since the anodic oxide film forming treatment agent 10 is increased in viscosity in comparison with a liquid electrolytic solution, the reaction that generates the anodic oxide film 14 can be promoted, and the film formation rate of the anodic oxide film 14 can be increased without requiring an increase in the electrolytic voltage. Accordingly, by means of a simple configuration, it is possible to increase the film formation rate of the anodic oxide film 14 and to bring about thickening of the film, while suppressing the occurrence of non-uniformity in the film thickness.

In the above-described embodiments, electrolytic degreasing is carried out in the degreasing step, however, the present invention is not particularly limited to this feature, and degreasing by immersion may be carried out using the degreasing treatment agent 20. In this case, the electrode 22 need not necessarily be provided in the degreasing treatment agent 20. Further, the degreasing step can be carried out without the application of vibration.

In the above-described embodiments, the degreasing treatment agent 20, which is made of a viscous substance, is used to perform the degreasing treatment on the film forming site 12*a*. However, instead of this feature, a general degreasing treatment can be implemented on the film forming site 12*a* utilizing a liquid sodium hydroxide aqueous solution. Further, an alkaline aqueous solution may be used which differs from the sodium hydroxide aqueous solution.

EXAMPLES

Example 1

A sulfuric acid aqueous solution having a concentration of 15 wt % was used as the electrolytic solution. "ADEKA NOL GT-730", "ADEKA NOL GT-1306", and "ADEKA NOL UH-752", which were described above, were used as the nonionic surfactant. For each type, the nonionic surfactants were mixed with the electrolytic solution so as to result in the concentrations shown in FIG. 3, whereby the anodic oxide film forming treatment agents 10 of Examples A through J were obtained. Measurement results in which the viscosities of the anodic oxide film forming treatment agents 10 were measured at room temperature are also shown in FIG. 3.

In relation to a low viscosity range of 0.4 to 1,000 mPa·s, measurement of viscosity was carried out using a rotational vibration type viscometer "Visco Mate VM-10A-L" (trade name) manufactured by Sekonic Corporation. Further, in relation to a high viscosity range of 1,000,000 to 40,000,000 mPa·s, measurement of viscosity was carried out using the aforementioned "Viscotester VT-04F". Incidentally, when these viscometers were used, it was not possible to measure the viscosities of the anodic oxide film forming treatment agents 10 of Examples A, C, D, and G.

As shown in FIG. 3, it was confirmed that the flowability of the anodic oxide film forming treatment agents 10 of all of Examples A through J was lower than that of the liquid electrolytic solution (the sulfuric acid aqueous solution having a concentration of 15 wt %). More specifically, by using the nonionic surfactants, it was understood that the electrolytic solution could be satisfactorily increased in viscosity.

Further, as described above, in order to easily maintain a shape that covers the film forming site 12*a* while leaving the non-forming site 12*b* exposed, in the case that the viscosity at room temperature was set to be greater than or equal to 10,000 mPa·s, it was confirmed that the anodic oxide film forming treatment agents 10 of at least examples B, E, F, I, and J could suitably be used. More specifically, the anodic oxide film forming treatment agents 10 could suitably be used, which were obtained by mixing into the electrolytic solution "ADEKA NOL GT-730" and "ADEKA NOL GT-1306" so as to be greater than or equal to 10 wt %, or "ADEKA NOL UH-752" so as to be greater than or equal to 27 wt %.

Moreover, in the case that agar was mixed in the aforementioned electrolytic solution instead of the above-described nonionic surfactants, the weight of the agar with respect to the weight of the electrolytic solution became excessive, and it was difficult for the viscosity thereof at room temperature to be greater than or equal to 10,000 mPa·s.

Example 2

(1) Substrate

A test piece having dimensions of 40 mm×100 mm was cut out from a plate material manufactured from pure aluminum (A1050) having a thickness of 2.0 mm, to thereby obtain a substrate 12. A portion of one surface of the substrate 12 was set as the film forming site 12*a*, and the remainder thereof was set as the non-forming site 12*b*. The area of the film forming site 12*a* was 20 mm×20 mm.

(2) Anodic Oxide Film Forming Treatment Agent

As described above, "ADEKA NOL GT-730" was used as the nonionic surfactant. Further, as the electrolytic solution, a sulfuric acid aqueous solution having a concentration of 15 wt % was used. By mixing the nonionic surfactant with respect to the electrolytic solution so as to have a concentration of 10 wt %, the electrolytic solution was increased in viscosity, and the anodic oxide film forming treatment agent 10 was manufactured.

(3) Formation of Anodic Oxide Film

After the cathode 30 was disposed in the anodic oxide film forming treatment agent 10 of the above-described item (2) and cooled to −5° C., the anodic oxide film forming treatment agent 10 was placed in contact with the film forming site 12*a* of the substrate 12 of the above-described item (1). Note that the cathode 30 may be disposed therein after the anodic oxide film forming treatment agent 10 has been cooled. Next, using the substrate 12 as an anode, energizing or conduction of electricity was carried out between the substrate 12 and the cathode 30. At this time, the electrolytic voltage was adjusted so that the current density was 10 $A/dm^2$.

Consequently, the anodic oxide film 14 was formed on the film forming site 12*a* exclusive of the non-forming site 12*b*. In this case, the time (film formation time) required until the anodic oxide film 14 having a thickness of 30 μm was obtained was 11 minutes.

Comparative Example

For the purpose of comparison, an anodic oxide film was formed on the film forming site 12*a* of the substrate 12 of the above-described item (1), by a general method in which a liquid electrolytic solution that was not increased in viscosity (an aqueous solution of oxalic acid having a concentration of 15 wt %) was used in place of the anodic oxide film forming treatment agent 10 of the above-described item (2). More specifically, a masking material (not shown) was disposed on the substrate 12 so as to expose the film forming site 12*a* and to cover the non-forming site 12*b*.

The electrolytic solution was stored in a treatment tank (not shown), and the substrate 12 and the cathode 30 were immersed in the electrolytic solution. In addition, using the substrate 12 as an anode, energizing or conduction of electricity was carried out between the substrate 12 and the cathode 30. At this time, the electrolytic voltage was adjusted in the same manner as in the above-described item (3). Further, inside the treatment tank, the electrolytic solution was cooled using a chiller or the like, and the temperature of the electrolytic solution was maintained at a temperature of less than or equal to 30° C. Consequently, the anodic oxide film was formed on the film forming site 12*a* exclusive of the non-forming site 12*b*. In the comparative example, the time (film formation time) required until the anodic oxide film having a thickness of 30 μm was obtained was 185 minutes.

From the foregoing, it was understood that, in Example 2, the film formation rate of the anodic oxide film 14 could be made faster by 94% in comparison with the film formation rate of the comparative example. Consequently, in accordance with the anodic oxide film forming method in which the anodic oxide film forming treatment agent 10 according to the present embodiment is used, as compared with a case in which a liquid electrolyte that is not increased in viscosity is used, it is possible to remarkably increase the film formation rate of the anodic oxide film 14 without increasing the electrolytic voltage.

What is claimed is:

1. An anodic oxide film forming method of forming an anodic oxide film on a substrate made of aluminum or an aluminum alloy, comprising:

a contacting step of bringing an anodic oxide film forming treatment agent, which is made of a viscous substance obtained by increasing a viscosity of an electrolytic solution by a nonionic surfactant, into contact with the substrate; and an energizing step of using the substrate as an anode, and carrying out conduction of electricity between the substrate and a cathode provided in the anodic oxide film forming treatment agent; and a degreasing step in which, prior to the contacting step, a degreasing treatment agent, which is made of a viscous substance obtained by increasing a viscosity of an aqueous solution of sodium hydroxide by a nonionic surfactant, and having a shape covering a film forming site where the anodic oxide film is formed on the substrate, while leaving a non-forming site exclusive of the film forming site of the substrate to remain exposed, is brought into contact with the film forming site to perform a degreasing treatment thereon.

2. The anodic oxide film forming method according to claim 1, wherein, in the contacting step, the anodic oxide film forming treatment agent, which covers the film forming site, and which is of a shape that allows the non-forming site to remain exposed, is brought into contact with the film forming site.

3. The anodic oxide film forming method according to claim 2, wherein, in the contacting step, the anodic oxide film forming treatment agent, which has a viscosity at room temperature of greater than or equal to 10,000 mPa·s, is brought into contact with the substrate.

4. The anodic oxide film forming method according to claim 2, wherein, in the contacting step, the anodic oxide film forming treatment agent, which has been cooled to a temperature of −30° C. to 0° C., is brought into contact with the film forming site.

5. The anodic oxide film forming method according to claim 2, wherein, in the degreasing step, vibration is applied in a state in which the degreasing treatment agent is in contact with the film forming site.

* * * * *